United States Patent [19]

McCullen

[11] Patent Number: 4,695,057

[45] Date of Patent: Sep. 22, 1987

[54] BINGO GAME MARKING TEMPLATE

[76] Inventor: Carol A. McCullen, 459 San Juan, St. Charles, Mo. 63303

[21] Appl. No.: 736,269

[22] Filed: May 22, 1985

[51] Int. Cl.[4] ..... A63F 3/06

[52] U.S. Cl. ..... 273/269; 273/284

[58] Field of Search ..... 273/269, 284; 434/81, 434/84, 85, 87, 88

[56] References Cited

U.S. PATENT DOCUMENTS

| | | | |
|---|---|---|---|
| 3,374,558 | 3/1968 | Smith | 273/284 X |
| 3,873,092 | 3/1975 | Fagan | 273/269 X |
| 3,913,921 | 10/1975 | Bourassa | 273/269 |
| 3,984,107 | 10/1976 | Nelson | 273/269 |
| 4,133,536 | 1/1979 | Cole | 273/269 X |

FOREIGN PATENT DOCUMENTS

| | | | |
|---|---|---|---|
| 924900 | 4/1973 | Canada | 434/85 |

*Primary Examiner*—Anton O. Oechsle

*Attorney, Agent, or Firm*—Rogers, Howell, Moore & Haferkamp

[57] ABSTRACT

A masking template for use with bingo games, the mask comprising an obscuring sheet of plastic material to fit over the numbered bingo game sheets and having openings to expose only the numbers of the particular game being called. A binder of such sheets is provided, each sheet having a different group of openings to accommodate different games and the sheets are to be notched and coded so that the player can quickly see how to reach the sheet of the game to be played at any given time.

5 Claims, 7 Drawing Figures

FIG. 4.
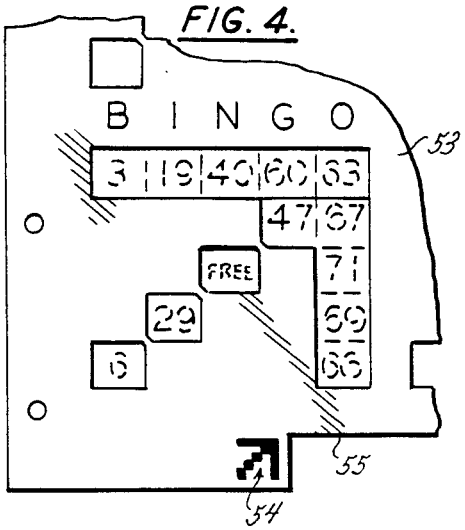
FIG. 6.
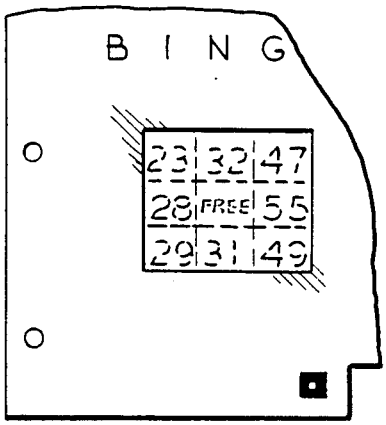
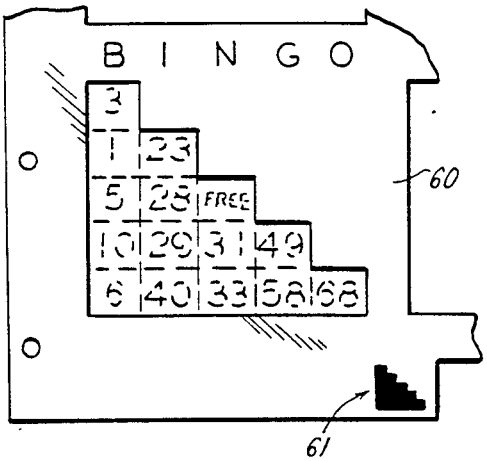
FIG. 5.
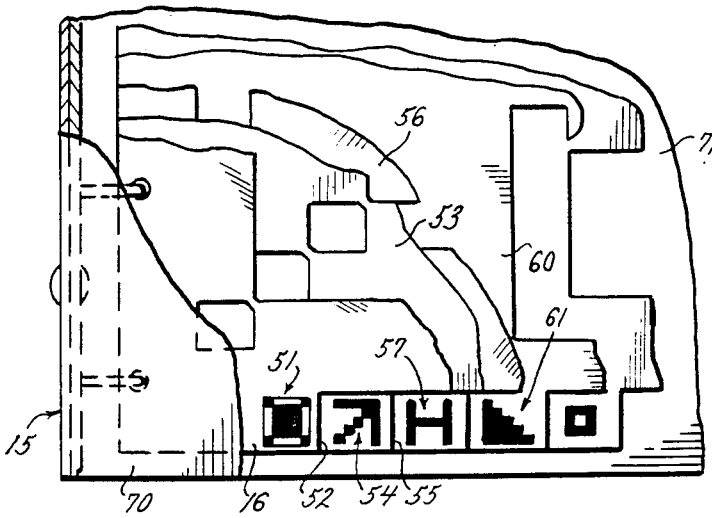
FIG. 7.

BINGO GAME MARKING TEMPLATE

BACKGROUND OF THE INVENTION

Bingo is a game that is played with a board containing blocks, usually three, six or nine in number, each block having a set of twenty-five numbers arranged to form a square. The numbers are chosen either at random or by some system. Each player in the game obtains a sheet with the blocks on it. A caller then calls numbers at random and the player marks each spot on this sheet that has a number corresponding to the one called.

The game takes many different forms. It can involve a straight line arrangement in which the player wins who gets five numbers in a block in a straight line either across, vertically, or at an angle, or it can involve many other different patterns of numbers, one of which is illustrated in FIG. 1. Other such examples are the letter "X", the letter "Y", picture-frame, the snowflake, the letter "T", arrow, top-hat, etc. Each of them involves a different set of squares that are to be used in that particular game. In these other games, there may be any arrangement and any number of the squares that are required for winning the game.

With such a miscellany of games that can be played off the same bingo sheets, players may find difficulty in quickly isolating the particular squares involved in the specific game chosen at any given time. The present invention is designed to make that easy for the players.

This invention therefore comprises a combination of one or more templates, each template being of generally opaque material, and having a cutout arrangement corresponding to each of the blocks on a bingo sheet, and each cut out exposing only the particular numbers to be used in any specific game being played. Thus, as will appear for illustration in FIG. 1, the present template could provide openings exposing only the four corners and the nine center numbers, and covering the rest. With such an arrangement, the player avoids the confusion caused by having other numbers exposed. The player may then daub, or otherwise mark, the numbers on his board as they are called.

Since the player usually uses an ink dauber to indicate that his numbers have been called, the template is preferably made of plastic so that any such marks can be cleaned off after each use. It should be made of a light plastic sheet for that purpose.

Templates corresponding to the various kinds of bingo games are to be assembled in a binder. The templates are notched and keyed so that the particular design can be readily spotted and turned to.

The template is so constructed that even all of the outside squares may be open in the template around its edges and only the inner part screened over.

In the drawings:

FIG. 1 is a broken view of a bingo sheet that would have nine blocks of squares and numbers, each block containing twenty-five squares with numbers. These sheets are usually supplied by the operator of the game. The lower part of this FIG. 1 shows a portion covered by a template of the present invention;

FIG. 4 is a view of a portion of the template block of an arrow pattern with the bingo sheet numbers in phantom;

FIGS. 5 and 6 are partial views of templates for a couple of additional designs of games; and FIG. 7 is a partial view of a binder of templates.

DESCRIPTION OF PREFERRED EMBODIMENT

Figure 1:
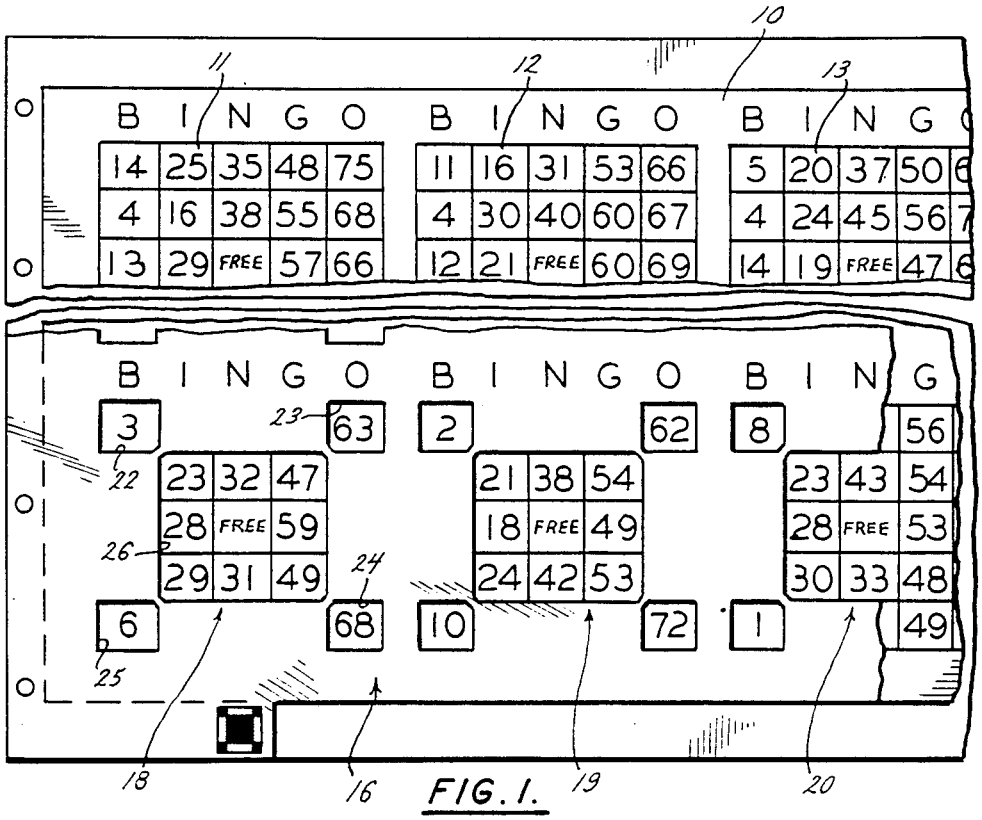

A bingo sheet 10 normally has the nine blocks of number sets such as those shown on FIG. 1, at 11, 12 and 13, each block having an individual miscellany of numbers in each of the squares thereon. Each player is given a sheet of this kind for each game and each of the sheets is different in its choice of numbers in the squares of its blocks.

In the present invention, it is planned to have a book 15 of templates such as 16 (see FIG. 7), each of which affords a different design of the game. When the caller designates which game is to be played, the player will turn to that template and place it over his bingo sheet 10 and, as will be shown, it will then expose only those squares in each block that are relevant to the particular game being called.

Figure 2:
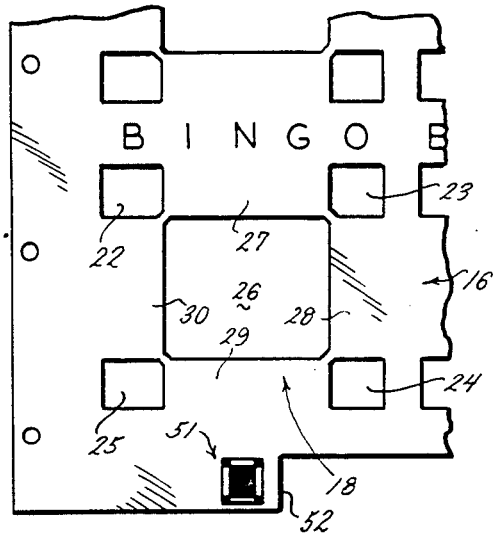
FIG. 2 is an enlarged partial view of one of the templates.

Each template 16 comprises a series of blocks, such as 18, 19 and 20 in FIG. 1, corresponding to the number of blocks in the bingo sheet and designed so that one block will overlie each of the blocks of numbers of the bingo sheet. In FIG. 2, the plastic sheet template 16 is shown apart from the bingo sheet. It has one block 18 completely illustrated, with four corner openings 22–25 that expose the four corner squares, and it has a large center opening 26 that can expose the nine center squares. The plastic sheet has covers 27–30 that conceal or obscure all of the unused numbers.

FIG. 1 shows the template 16 of FIG. 2 over the sheet 10.

As noted, the plastic sheet 12 should be of lightweight plastic that is either opaque or partially opaque so as to emphasize the exposed numbers and to conceal or deemphasize the unused numbers for the particular game being played. It is of course understood that each block on the sheet will have a block on the template just like the one shown for the particular game being played.

Figure 3:
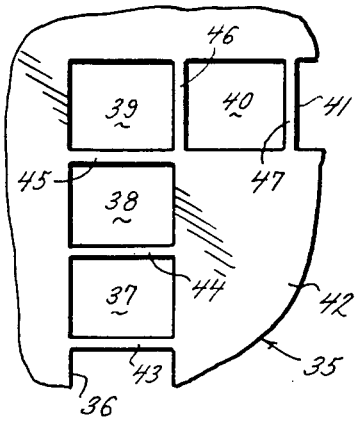
FIG. 3 is an enlarged view of a portion of a template showing how the inner part thereof can be supported when all of the outer squares are open.

In FIG. 3 we have illustrated a corner of a template 35 having only its edge openings 36–41 cut out, leaving a center portion 42 that will cover all of the nine center squares. This Figure is designed to illustrate how the portion 42 is supported from the edges of the sheet 35 by virtue of the connecting strips 43–47 that extend to the margin of the template.

FIGS. 4, 5 and 6 are illustrations of templates providing for other games. FIG. 4 illustrates the game generally called an Arrow game; FIG. 5 illustrates the game generally called a Stair-Step game; and FIG. 6 illustrates the game called Picture Frame. In each of these illustrations, different ones of the number squares have been exposed and the remaining ones concealed.

FIG. 7 is designed to show template sheets that are bound together in a book 15, with keys to lead the player to the proper sheet for the game being called. Thus, in FIG. 7 the top template 16 has the snowflake design symbol 51 at the bottom. This sheet is cut away as shown by a large notch 52 to expose the corresponding indexes of all of the sheets below it. Thus, the next template 53 below template 16 has the Arrow index 54 at its bottom part adjacent the notche 55, and the third template 56 below sheet 53 has the H symbol 57, and the next below sheet 60 has the Stair-Step symbol 61, etc.

Thus, there can be a sheet in the binder for each of the different styles of games that can be played. The binder has a front cover 70 and a back cover 71.

In use: the player will take the book of templates with him (or her) to the bingo game. There he will acquire a bingo sheet for each bingo game to be played. The caller will indicate which style of game will be played and the player will then look at the bottom edge of his templates in the binder and, by the index symbol, there select the game thus designated, and open the book to it. He will then slip the bingo sheet in under that particular template. He may also slip a plain white sheet below the bingo sheet to make it show up better. With the bingo sheet thus arranged, the exposed squares will be only those that may be called by the caller to achieve bingo.

Since the squares not to be used in a particular game are thus covered up by the template, the player is not confused by having to select out the particular numbers to be part of the game. As a number is called which corresponds to one of those in one of his blocks, the player will put a marker on that particular square on the bingo sheet part that shows through the template. Usually this is done with a dauber of ink of some kind that delineates the number being daubed from the other numbers not yet called. If a player finds that he has covered all of the exposed squares of one of his blocks, he calls "bingo" and has won that particular game.

One advantage of making the template of plastic is that it can be re-used. If the player daubs ink on one of the covering parts of the template, it can be washed off or erased without permanent injury to the template.

Thus, this invention makes the game easier and quicker to follow, and it can be used over and over again. It is quick to put into use because of the indexes at the bottom edge, and it can be made in a relatively inexpensive manner.

The caller for the game may use a Master Board such as shown in U.S. Pat. No. 3,984,107. This board contains all of the square cut out, and it is designed to have the particular game being played designated by darker markers covering certain ones of the squares.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

What I claim is:

1. In combination a bingo sheet having a rectangular block of numbers thereon, each number in the block being disposed in a rectangular space defined by horizontal and vertical limits, a template for use by a player in playing bingo games, the template being adapted to overlie the rectangular block of numbers on the bingo sheet, the template being readily removable from the sheet, the template being larger than the size of the rectangular block of numbers so as to provide marginal portions outside of the block of numbers, and having, within the rectangular area corresponding in size to the size of the rectangular block of numbers, openings cut out to expose only the numbers on the bingo sheet that are required to be used in the game being played, and having uncut portions that are at least somewhat opaque to obscure the numbers that are not being played in that particular game, the openings in the template having horizontal and vertical edges corresponding to the edges of the numbers of the blocks' horizontal and vertical openings, the openings being of sufficient size to admit indicating means to be placed on the bingo sheet by the player, the template being separate from and readily removable from the sheet to leave the indicating means visible on the sheet, an edge of each opening being connected with the margin of the template so that the template can remain integral.

2. The combination of claim 1 including a plurality of the rectangular blocks on the sheet of numbers, and including a plurality of template blocks to correspond to the numbered blocks on the sheet for bingo, each block in the template having the openings cut out to expose only the numbers of the bingo to be used in that particular game and having the uncut portions to obscure the remaining number squares of the bingo game that are not to be used at that time.

3. In the combination of claim 1, a plurality of such templates each having a different arrangement of cutouts and uncut obscuring portions representing different games of bingo to be played, all of the same being bound together in a book-type binder so that the player may have a template for whatever game is selected by the called to be played at any given time.

4. In the combination of claim 3 including the book of templates wherein there are tabs, one for each template, means to expose a tab on every template, such that each tab below the first ones are always visible, each such tab having an index indicating the particular arrangement of cutouts and obscuring portions.

5. In the combination of claim 3, a binder of templates wherein there is a light colored sheet in the binder for insertion below the bingo sheet being viewed through a template.

* * * * *